United States Patent [19]

Crane

[11] 4,101,956

[45] Jul. 18, 1978

[54] FLUORESCENT FIXTURE

[75] Inventor: Roy B. Crane, Wilmington, Mass.

[73] Assignee: Keene Corporation, New York, N.Y.

[21] Appl. No.: 745,482

[22] Filed: Nov. 26, 1976

[51] Int. Cl.[2] ..... H05B 33/02; H01R 33/08

[52] U.S. Cl. ..... 362/217; 339/53; 362/457

[58] Field of Search ..... 240/51.11 A, 153; 339/50 R, 51, 52 R, 53, 54, 56; 362/217, 219, 457

[56] References Cited

U.S. PATENT DOCUMENTS

| | | | |
|---|---|---|---|
| 2,446,461 | 8/1948 | Diver | 339/54 |
| 2,452,137 | 10/1948 | Murino | 339/53 |
| 3,065,343 | 11/1962 | Zurawski | 240/51.11 R |

*Primary Examiner*—J D Miller
*Assistant Examiner*—Peter S. Wong
*Attorney, Agent, or Firm*—Kane, Dalsimer, Kane, Sullivan & Kurucz

[57] ABSTRACT

An improved fluorescent fixture is provided wherein guides extending from the fixture socket serve to receive the pins of an associated fluorescent lamp tube, properly align the tube so that the pins may enter an opening in the socket, and rotate the tube to insure engagement between the pins and socket contacts as well as mechanical engagement to maintain the lamp tube in position.

1 Claim, 5 Drawing Figures

FIG. 3
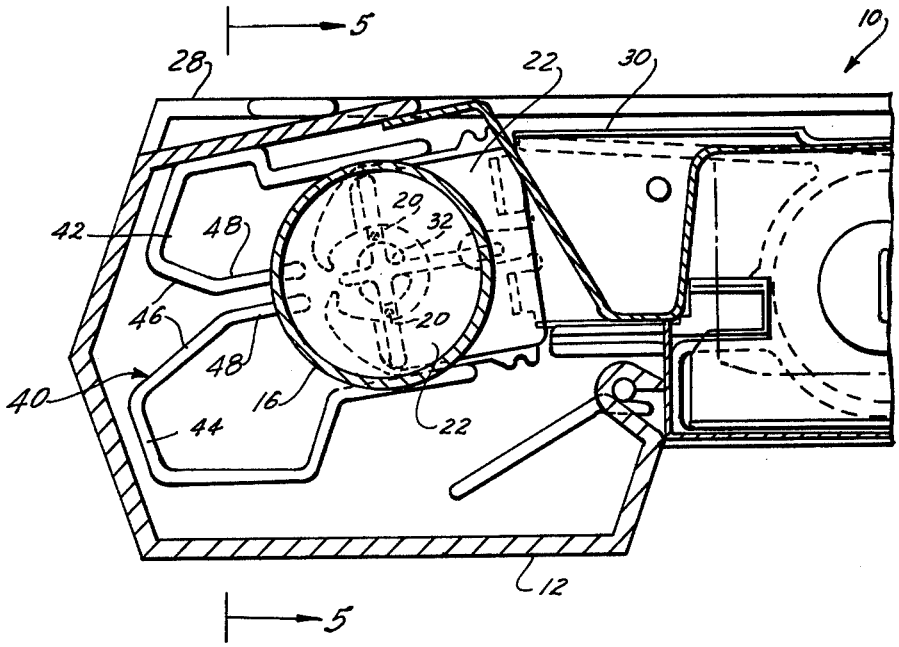
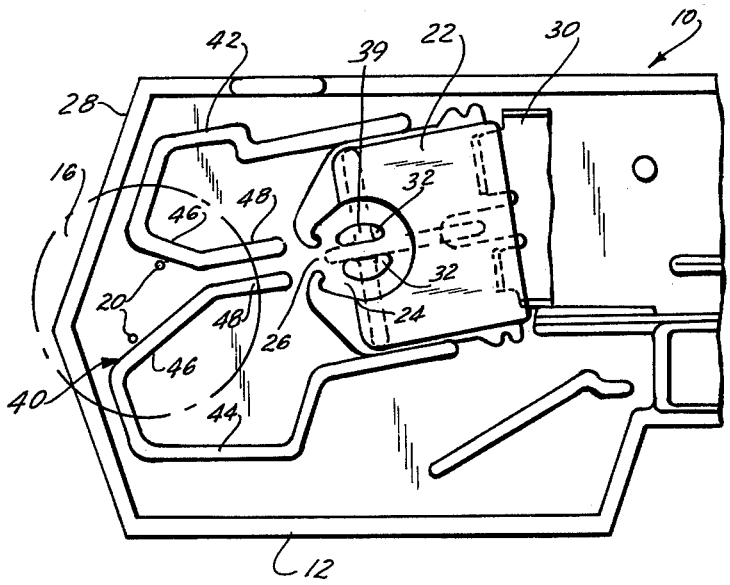
FIG. 4

FLUORESCENT FIXTURE

BACKGROUND OF THE INVENTION

The present invention relates to fluorescent fixtures and more particularly to an improved socket arrangement for such fixtures which facilitates the placement of fluorescent lamp tubes therein.

The conventional fluorescent light lamp comprises an elongated cylindrical tube, the ends of which are fitted with caps from which two pins extend. The tube may range in length from several inches to several feet, depending on the illumination required. The fluorescent lamp is activated by applying electric current to the pins through appropriate contacts in sockets of the associated fixture. The sockets also serve to hold the lamp in position by providing supporting surfaces which engage the pins when the pins engage the contacts.

Heretofore, in order to install a fluorescent lamp tube into a fixture, it was necessary that the installer first align the pins at both ends of the tube with openings in the socket and then push the tube into the socket. Thereafter, the tube had to be manually rotated so that the pins at both ends simultaneously engage the appropriate socket contacts and mechanically interlock with the socket support surfaces to provide the necessary electrical and mechanical interconnections. Any misalignment of the ends of the tube or premature rotation would result in a defective electrical or mechanical connection or both.

The opening in the socket is on the order of a quarter of an inch. Thus, it should be apparent that the greater the tube length, the more difficult it becomes to maintain the alignment of the tube ends for purposes of inserting both sets of pins at opposite ends of the lamp into their respective sockets. In addition, the installer when rotating the lamps must be certain that both ends are rotated properly to make the necessary electrical connections. This has caused problems to experienced electricians as well as homeowners faced with the task of replacing a spent lamp.

In view of the above, it is the principal object of the present invention to provide an improved fluorescent fixture which automatically simplifies the task of lamp installation.

A further object is to provide an improved socket construction which converts the complex manipulations previously required of an installer into a much simpler, straightforward thrusting action.

A still further object of the present invention is to provide an improved socket construction which is compatible with conventional fluorescent fixtures and may be incorporated therein without requiring any drastic design change.

A still further object is to provide such a socket construction which is relatively inexpensive and will not substantially effect the overall costs of the associated fluorescent fixture.

SUMMARY OF THE INVENTION

The above and other beneficial objects and advantages are attained in accordance with the present invention by providing, in a fluorescent fixture of the type having a pair of sockets positioned at opposite ends of a housing, guide means affixed to the housing positioned in front of the socket opening having cam surfaces to receive and direct the pins of an associated fluorescent lamp into the socket opening to make electrical engagement with the socket contacts in mechanical interengagement with appropriate surfaces of the socket design to support the pins.

BRIEF DESCRIPTION OF THE DRAWINGS

In the accompanying drawings:

FIG. 3 is a fragmentary sectional view of an assembled end portion of the fixture;

FIG. 4 is a fragmentary simplified end elevational view depicting the manner in which a lamp (shown in phantom) may readily be installed in the fixture; and, FIG. 5 is a sectional view taken along reference lines 5—5 of FIG. 3 in the direction indicated by the arrows.

DETAILED DESCRIPTION OF THE PREFERRED EMBODIMENT

Reference is now made to the drawings wherein an improved fluorescent fixture 10 in accordance with the present invention is shown. The fixture depicted is of the pendant mounted type, that is, the fixture housing 12 is secured to the ceiling of an installation site via support rods 14. The rods are hollow so that suitable electrical connections for the fixture may be brought through one or both of the supports for connection to the fixture internal wiring as required. It should be made clear at the outset, however, that the present invention is in no way restricted to any particular type of fluorescent fixture or housing and would be equally applicable to other types of fixtures.

Figure 1:
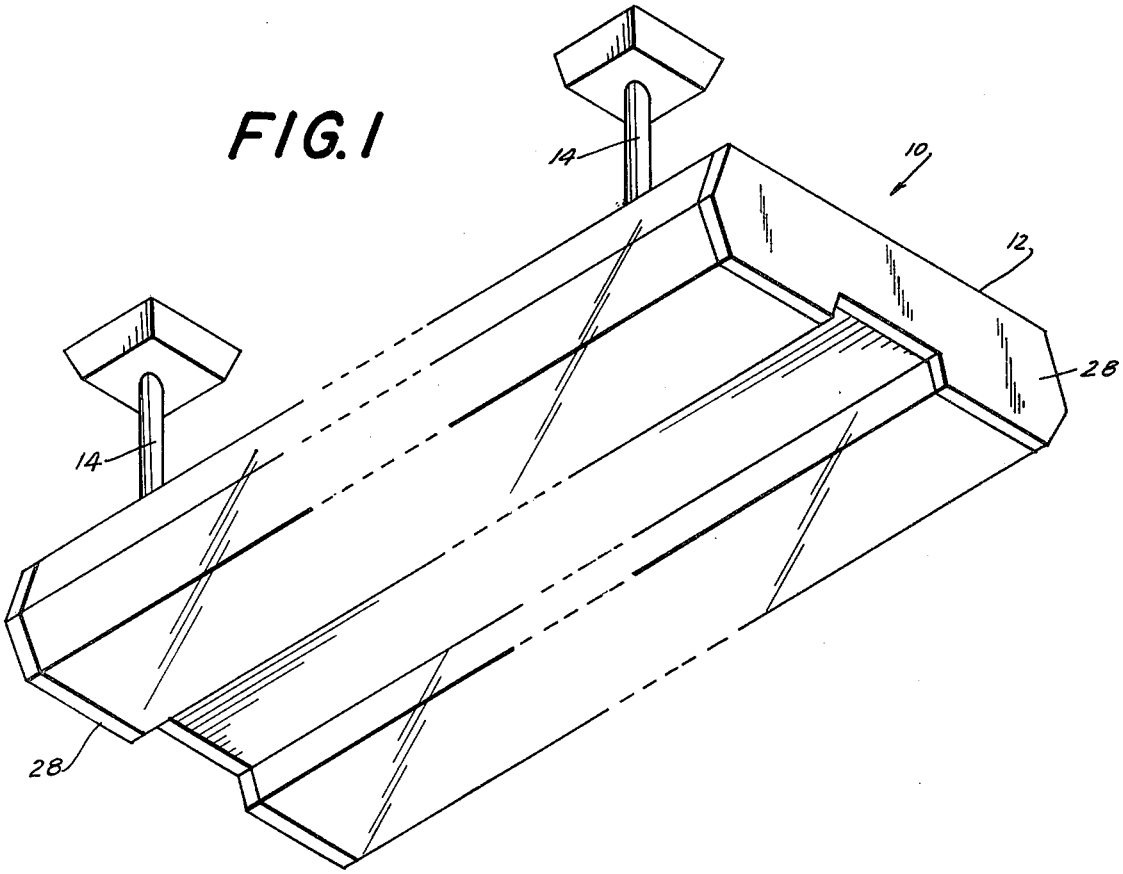
FIG. 1 is a perspective view of a fluorescent fixture in accordance with the present invention.
Figure 5:
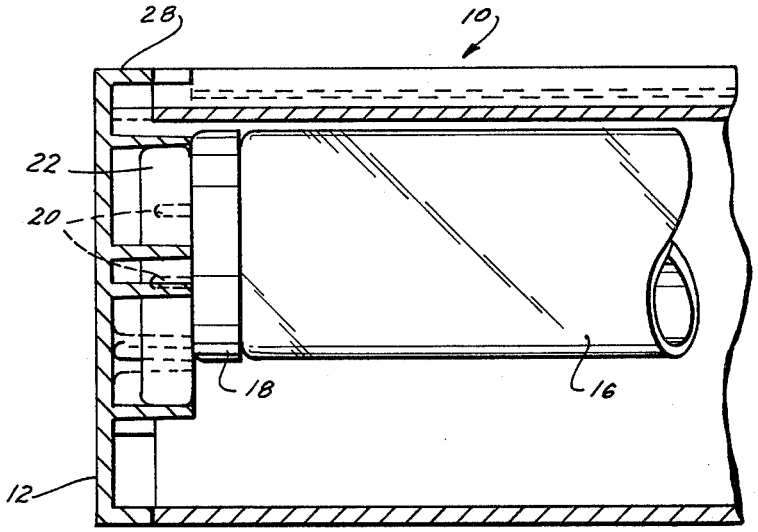
Figure 2:
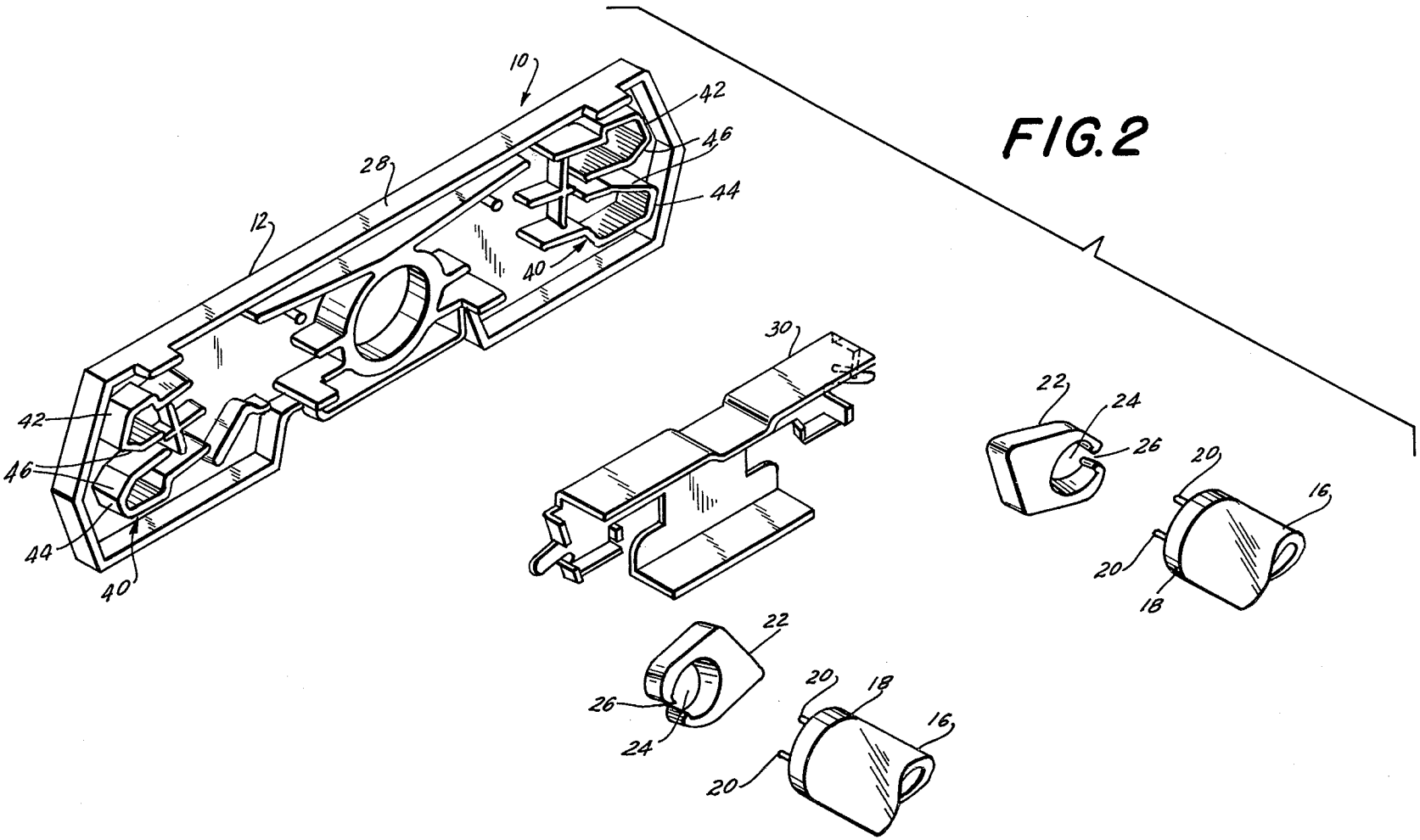
FIG. 2 is an exploded perspective view of an end portion of the fixture of FIG. 1.

As can be seen, the housing 12 is formed with compartments which contain therein fluorescent lamps 16. As shown in FIG. 2, these lamps 16 comprise elongated glass tubes having caps 18 at the ends thereof. A pair of pins 20 extend through each of the caps and serve to enable electrical connections to be made between the lamp and fixture. To this end, the pins are designed to fit in sockets 22 mounted to the fixture to engage electrical contacts contained therein and to be captured by portions of the socket to hold the lamp in position and prevent its falling from the fixture.

Each of sockets 22 comprises an inverted "C"-shaped member usually formed of a nonconducting, insulating material such as a suitable plastic or ceramic material. The member is provided with a cutout center portion 24 having an opening 26 extending through the socket member communicating with the center portion.

In the disclosed embodiment, the sockets 22 are mounted in the end caps 28 of fixture 10 and held in position by appropriate clips 30. Contained within the socket are a pair of electrical contacts 32 which must engage the lamp pins 20. The contacts 32 are secured to support means 39. The contacts, in turn, are connected with the internal wiring of the fixture so that current to the lamp may be fed through the contact 32 to the lamp pins. As can be seen in FIG. 3, when a lamp is positioned within the socket and rotated the pins 20 are captured between the contacts 32 and walls defining the cutout 24 to insure a proper electrical connection as well as a secure mechanical interlock which prevents the lamp from falling from the fixture. As previously stated, prior to the present invention, it was necessary for the installer to position the pins through cutout 26 manually and thereafter carefully rotate the lamp to effect the above described condition at both ends of the lamp.

In accordance with the present invention, guide means generally designated by the numeral 40 are provided on the inner surfaces of each end cap 28. The guide means comprise a pair of members 42 and 44 having first portions 46 with surfaces that are aligned to converge toward the socket opening. The members 42 and 44 are further provided with second portions having surfaces 48 generally parallel to each other extending from the convergent ends of surfaces 46 toward the open end 26 of the socket. As can be seen, the parallel walls 48 thus serve to direct the convergent ends of surfaces 46 to the opening 26 so that the guide means resemble a funnel in section.

As can be seen in FIG. 4, when the pins 20 of a lamp 16 are positioned between the convergent walls 46 and urged toward the fixture these walls will act as a cam to guide the pins so that they automatically align generally parallel with walls 48. In this position, the pins 20 can readily enter the opening 26 of the socket. When both pins at each lamp end are within the socket the lamp can then readily be rotated so that one pin travels upwardly and the other pin travels downwardly until captured between the contact and socket in the installed position. Thus, all one need do to install a lamp in the fixture of the present invention is to position the lamp pins anywhere within the space defined by the convergent walls 46. Thereafter, by simply pushing on the lamp, the camming surfaces 46 and 48 automatically align the lamp for entrance into the socket. When the lamp ends are totally captured within the socket, the lamp can be rotated readily into the captured position. In practice therefore, all an installer need do is place the lamp in the guide members and push on it, the guide members will automatically convert the installer's pushing action into the required alignment and motion of the lamp for proper installation.

Thus, in accordance with the above description, the aforementioned objects are effectively attained. It should be apparent that the present invention would be appropriate with any type of fluorescent fixture and thus, as stated earlier, details of the fixture housing itself are immaterial.

Having thus described the invention, what is claimed is:

1. In a fluorescent light fixture of the type including a housing having a pair of sockets positioned at opposite ends thereof for engagement with the pins of a fluorescent lamp, said sockets each having surfaces defining a cutout center portion, an opening extending through ends of said sockets communicating with said cutout for receiving said pins, contacts for electrical connection with said pins mounted in said cutout and surfaces of said socket for mechanical interengagement with said pins to secure said lamp in position, the improvement comprising: guide means affixed to said housing positioned in front of said socket opening to direct said lamp pins through said socket opening to siad cutout and into position to be rotated into electrical engagement with said contacts and mechanical interengagement with said surfaces; said guide means comprises a pair of members each including first portions thereof having surfaces spaced apart from each other and converging toward said socket opening and second portions thereof positioned between said first portions and socket opening and having surfaces parallel to each other and spaced apart a distance substantially equal to that of said opening; and, said sockets are mounted to end caps at opposite ends of said housing and said guide means are formed integrally with the internal surfaces of said end caps.

* * * * *